US005237723A

United States Patent [19]

Little

[11] Patent Number: 5,237,723

[45] Date of Patent: Aug. 24, 1993

[54] DOOR HINGE

[75] Inventor: John B. Little, Shropshire, United Kingdom

[73] Assignee: ITW Ltd., Windsor, England

[21] Appl. No.: 865,154

[22] Filed: Apr. 8, 1992

[30] Foreign Application Priority Data

| | | | |
|---|---|---|---|
| Apr. 12, 1991 | [GB] | United Kingdom | 9107773 |
| Oct. 19, 1991 | [GB] | United Kingdom | 9122257 |
| Nov. 29, 1991 | [GB] | United Kingdom | 9125392 |

[51] Int. Cl.[5] ..... E05D 7/10; E05D 11/00

[52] U.S. Cl. ..... 16/273; 16/261; 16/263

[58] Field of Search ..... 16/261, 262, 263, 265, 16/270, 273, DIG. 40

[56] References Cited

U.S. PATENT DOCUMENTS

| | | | |
|---|---|---|---|
| 4,353,146 | 10/1982 | Brockhaus | 16/273 |
| 4,383,478 | 5/1983 | Jones | 16/273 |
| 4,793,021 | 12/1988 | Deasy et al. | 16/273 |
| 4,854,009 | 8/1989 | Brockhaus | 16/263 |
| 4,858,274 | 8/1989 | Harrison et al. | 16/270 |

*Primary Examiner*—W. Donald Bray
*Attorney, Agent, or Firm*—Schwartz & Weinrieb

[57] ABSTRACT

A hinge, particularly for a motor vehicle, comprises a hinge leaf 2 to which a hinge pin 4 is secured. The pin has a projecting end over which a bearing sleeve 8 tightly fits, the end of the pin and sleeve being receivable in a journal of a second hinge leaf 14. The sleeve 8 preferably incorporates a thrust washer 12, which may be integral with the sleeve to form a bush. The washer bears against a shoulder 6 formed on the pin and which abuts the leaf 2.

20 Claims, 2 Drawing Sheets

DOOR HINGE

FIELD OF THE INVENTION

This invention concerns improvements in or relating to door hinges, particularly for automobiles.

BACKGROUND

In the modern motor car the passenger doors have become increasingly complicated. Thus, particularly in the luxury car sector, the doors may be provided with loudspeakers, electric windows and mirrors, and central locking facilities. This makes the assembly of such accessories in situ more difficult in the limited space available, so that is has become usual for car doors to be manufactured as separate sub-assemblies for subsequent fitting to the vehicle body.

In consequence it is becoming common practice for door hinges to be made separable, or of the lift-off type, with hinge pins engageable in bushed journals. However, when the door is offered up to the vehicle body it is often difficult to correctly align the hinge pins so that they readily enter the journals. Additionally, it is desireable to reduce wear in the hinges without significantly increasing the size of the hinge assembly.

SUMMARY OF THE INVENTION

According to the present invention there is provided a vehicle door hinge comprising first and second pivoted members, a hinge pin secured to the first member with one end projecting therefrom, the second member being formed with a journal for receiving the projecting end of the pin, and a cylindrical sleeve fitted over at least part of the axial length of the pin for engagement with the journal.

Since the diameter of the cylindrical opening in the journal is as a consequence larger than in conventional hinges, the assembling of a door to a vehicle by hand is accordingly made easier due to the increased location tolerance.

Furthermore, the journal has an increased bearing surface area, resulting in lower bearing loads and hence reduced wear, while the corresponding effective increase in pin diameter serves to increase its strength.

Advantageously the outboard end of the pin protrudes beyond the sleeve and is formed with a taper to further facilitate entry of the pin into the journal.

Preferably the pin incorporates locating means to axially locate the sleeve therealong.

The bore of the journal may, if desired, be heat treated to increase its wear resistance.

The pin may be formed adjacent the first member with a shoulder to act as a thrust surface for the second member.

A thrust washer may be fitted between the shoulder and the second member.

Either or both of the sleeve and thrust washer may to advantage be made from low friction material, such as, for example, moulded plastic sintered iron or of "DU" material coated with PTPE.

The sleeve and washer may be formed integrally as a single bush.

The locating means may be a recess in the pin, in which case the sleeve is formed with a longitudinal split, enabling it to spring back into the recess. Where the sleeve and washer are formed as an integral bush, the latter may be pushed into the recess by a pair of crimping tools.

The hinge may include two or more pins aligned along the pivotal axis of the hinge, although the pins need not necessarily be mounted on the same member. Thus one pin can be mounted on the member which is secured to the vehicle body, while the other is mounted on the member secured to the door.

A door hinge in accordance with the invention may further be provided with an integral door check device, for example as described and claimed in British Patent Specification No. 2199888.

BRIEF DESCRIPTION OF THE DRAWINGS

The invention will now be described, by way of example only, with reference to the accompanying drawings, in which like reference characters designate like or corresponding parts throughout the several views and wherein.

DETAILED DESCRIPTION

Figure 1:
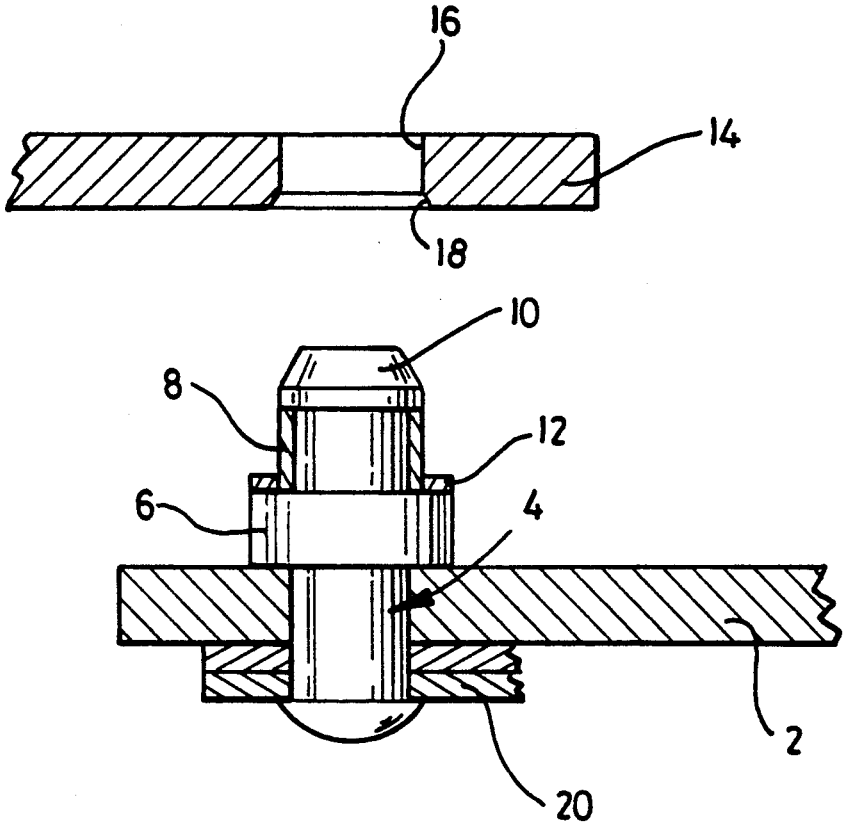
FIG. 1 is a side elevation view showing a car door hinge in accordance with the invention prior to being assembled.

Referring first to FIG. 1, a first member in the form of a plate or leaf 2 is provided with a hole in which is secured a hinge pin 4. The pin projects upwardly and has a flange 6 which abuts the leaf 2.

The upper side of the flange provides a shoulder against which sits a bearing insert or sleeve 8 tightly fitting over the pin. The end of the pin is formed with a taper 10 and is enlarged to capture the sleeve.

Fitting over the sleeve 8 against the shoulder of the flange 6 is a thrust plate or washer 12.

The pin 4 is received in a second member or leaf 14 formed with a bore or journal 16, shown aligned with the pin. The lower end of the journal is countersunk, as shown as 18.

Under the leaf 2 is shown a pair of flat springs 20, which form part of the check mechanism discovered in the above mentioned British Patent. The lower end of the pin 4 is peened over the springs to secure the pin and locate the springs.

It will be apparent that assembly of the two leaf components of the hinge is facilitated by virtue of the relatively large diameter of the journal 16, assisted by the taper 10 and the countersink 18 in the journal.

It will also be evident that the larger journal will result in lower bearing loads, and it is believed that load reductions of the order of 20% may be possible.

In practice two such pairs of hinge members are provided to secure a door to a vehicle body, one pair near the top and the other near the bottom of the door.

Figure 2:
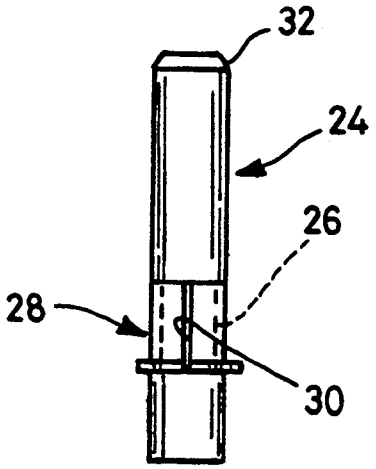
FIG. 2 is a side view of a modified hinge.

FIG. 2 shows a modification of a longer pin 24 formed with a recess 26 in which are located a sleeve and a washer formed integrally as a signal bush 28. The bush 28 includes a longitudinal split 30, enabling it to be splayed apart slightly on being assembled on to the pin from the top end having a taper 32, before springing into the recess 26.

Figure 3:
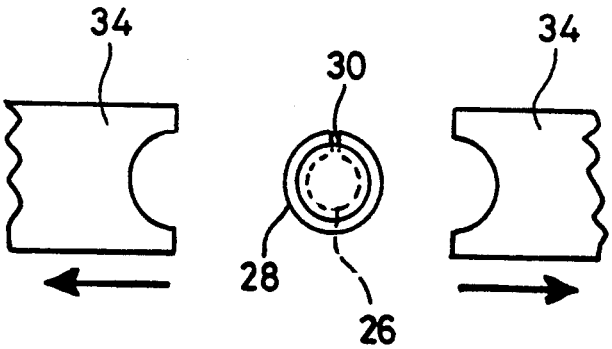
FIG. 3 is a plan view of the hinge pin of FIG. 2, showing a tool for crimping a bush on to the pin.

In practice, the pin 24 may have a diameter of 10 mm and the recess 26 may be 1 mm deep, that is, of 8 mm diameter.

Where the bush 28 is of insufficient resilience to spring into the recess 26 of its own accord, a pair of radially engageable tools 34 may be provided to crimp the bush into the recess, as shown in FIG. 3.

Obviously, many modifications and variations of the present invention are possible in light of the above teachings. It is therefore to be understood that within the scope of the appended claims, the present invention may be practiced otherwise than as specifically described herein.

I claim:

1. A door hinge, comprising:

first and second pivoted members;

a hinge pin secured to said first member with one end projecting therefrom;

said second member being formed with a journal for receiving said projecting end of said hinge pin;

said projecting end of said hinge pin comprising axially spaced flanged portions; and a cylindrical sleeve disposed about said projecting end of said hinge pin and interposed between said flanged portions of said hinge pin for pivotal engagement with said journal of said second member.

2. A hinge according to claim 1 in which the projecting end of the pin protrudes beyond the sleeve and is formed with a taper to further facilitate entry of the pin into the journal.

3. A hinge according to claim 1, in which the pin incorporates locating means to axially locate the sleeve therealong.

4. A hinge according to claim 1, in which the bore of the journal is heat-treated to increase its wear resistance.

5. A hinge according to claim 1, in which the pin is formed adjacent the first member with a shoulder to act as thrust surface for the second member.

6. A hinge according to claim 5 in which a thrust washer is fitted between the shoulder and the second member.

7. A hinge according to claim 6 in which at least one of the sleeve and the thrust washer is made from low friction material.

8. A hinge according to claim 7 in which said material is moulded plastic sintered iron.

9. A hinge according to claim 6, in which the sleeve and thrust washer are formed integrally as a single bush.

10. A hinge according to claim 1, further comprising:

spring means, which are components of a door check device, mounted upon said hinge pin.

11. A hinge as set forth in claim 7, wherein:

said low friction material comprises a material coated with PTFE.

12. A hinge as set forth in claim 1, wherein said first member comprises a vehicle door; and said second member comprises a vehicle body.

13. A hinge as set forth in claim 1, wherein:

said first member comprises a vehicle body; and said second member comprises a vehicle door.

14. A hinge as set forth in claim 12, wherein:

said hinge in is mounted upon an upper portion of said vehicle door.

15. A hinge as set forth in claim 12, wherein:

said hinge pin is mounted upon a lower portion of said vehicle door.

16. A hinge as set forth in claim 2, wherein:

said journal of said second member includes a countersunk portion for cooperating with said tapered portion of said projecting end of said hinge pin for facilitating said entry of said hinge pin into said journal.

17. A door hinge, comprising:

first and second pivoted members;

a hinge pin secured to said first member with one end projecting therefrom;

said second member being formed with a journal for receiving said projecting end of said hinge pin;

said projecting end of said hinge pin comprising annular recess means; and a cylindrical sleeve disposed about said projecting end of said hinge pin and within said annular recess means of said hinge pin for pivotal engagement within said journal of said second member.

18. A door hinge as set forth in claim 17, wherein:

said cylindrical sleeve comprises an axially split sleeve for enabling said cylindrical sleeve to be mounted within said annular recess of said hinge pin.

19. A door hinge as set forth in claim 17, wherein:

said projecting end of said hinge pin is tapered; and said journal of said second member includes a countersunk portion for cooperating with said tapered end of said hinge pin for facilitating entry of said hinge pin into said journal.

20. A hinge as set forth in claim 17, wherein:

said projecting end of said hinge pin comprises a pair of axially spaced flanged portions defining opposite end of said annular recess means for confining said cylindrical sleeve between said flanged portions and within said recess means.

* * * * *